US005512976A

United States Patent [19]

Kamano

[11] Patent Number: 5,512,976

[45] Date of Patent: Apr. 30, 1996

[54] IMAGE FORMING APPARATUS HAVING ROTATION RESISTANCE ADJUSTING MEANS FOR ADJUSTING ROTATION RESISTANCE ON A PHOTOSENSITIVE DRUM

[75] Inventor: Tadao Kamano, Shizuoka, Japan

[73] Assignee: Kabushiki Kaisha TEC, Shizuoka, Japan

[21] Appl. No.: 407,917

[22] Filed: Mar. 21, 1995

[30] Foreign Application Priority Data

Mar. 29, 1994 [JP] Japan ..... 6-059459

[51] Int. Cl.[6] ..... G03G 15/00

[52] U.S. Cl. ..... 355/200; 355/211

[58] Field of Search ..... 355/200, 211, 355/259

[56] References Cited

U.S. PATENT DOCUMENTS

| | | | |
|---|---|---|---|
| 4,638,993 | 1/1987 | Granzow et al. | 271/315 |
| 4,671,645 | 6/1987 | Saito et al. | 355/200 |
| 4,829,335 | 5/1989 | Kanemitsu et al. | 355/211 |
| 5,323,211 | 6/1994 | Fujii et al. | 355/200 |
| 5,327,197 | 7/1994 | Matsuura et al. | 355/211 |

FOREIGN PATENT DOCUMENTS

| | | |
|---|---|---|
| 0060030 A2 | 9/1982 | European Pat. Off. . |
| 2059609 A | 4/1981 | United Kingdom . |

*Primary Examiner*—Joan H. Pendegrass
*Assistant Examiner*—Sophia S. Chen
*Attorney, Agent, or Firm*—Frishauf, Holtz, Goodman, Langer & Chick

[57] ABSTRACT

An image forming apparatus includes a photosensitive drum, a rotation supporting unit for rotatably supporting the drum, a charger, an optical image forming unit, a development unit, a transfer unit and a cleaner, which are arranged along the outer circumferential surface of the drum in a rotational direction of the drum, and a rotation resistance adjusting unit for applying a rotation resistance on a region of the drum located outside of the image forming region, and being capable of adjusting a value of the rotation resistance applied on the drum. The development unit includes a development roller abutted to the image forming region of the circumferential surface of the drum and rotated in an opposite direction to the rotating direction of the drum. At least one of the supporting unit, charger, image forming unit, the transfer unit and the cleaner includes a rotation resistance member for applying a rotation resistance on the drum in an opposite direction to a direction of a rotation resistance applied from a development roller to the drum. A value of frictional torque T3 applied from the adjusting unit to the drum is so set that a relationship "T1<T2+T3" is satisfied, where T1 is a frictional torque applied from the development roller to the drum, and T2 is a frictional torque applied from the rotation resistance member to the drum.

2 Claims, 2 Drawing Sheets

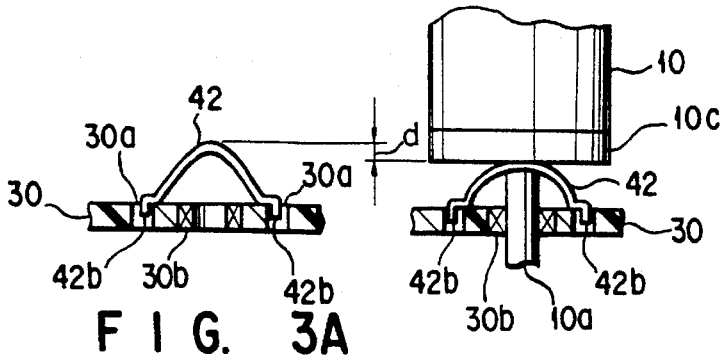
FIG. 3A
FIG. 3B
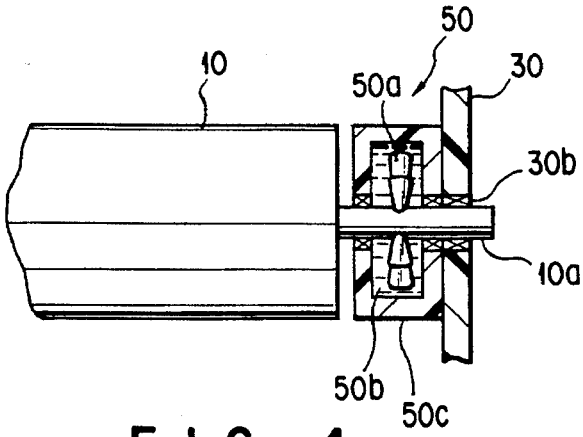
FIG. 4
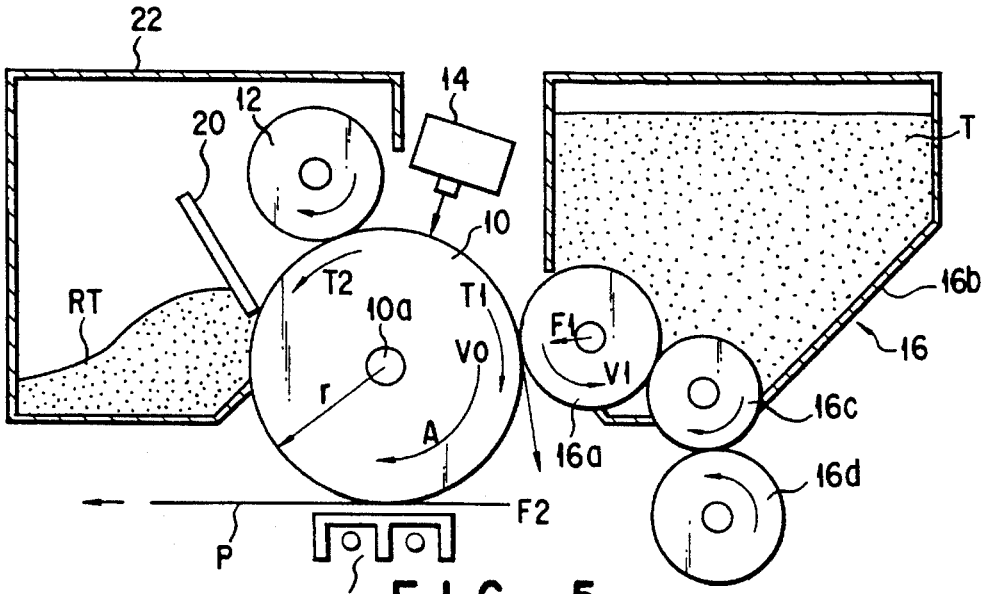
FIG. 5
(PRIOR ART)

IMAGE FORMING APPARATUS HAVING ROTATION RESISTANCE ADJUSTING MEANS FOR ADJUSTING ROTATION RESISTANCE ON A PHOTOSENSITIVE DRUM

BACKGROUND OF THE INVENTION

1. Field of the Invention

The present invention relates to an image forming apparatus such as a laser printer, an electrophotographic copying machine or an electrophotographic facsimile receiver.

2. Description of the Related Art

FIG. 5 schematically shows a longitudinal sectional view of a main portion of a conventional image forming apparatus of the above-described type. The main portion comprises a photosensitive drum 10, and further comprises a charger 12, optical image forming means 14, developing means 16, a transfer device 18 and a cleaner 20, all arranged along an outer circumferential surface of the photosensitive drum 10 in a rotating direction of the drum 10 indicated by an arrow A (the clockwise direction in FIG. 5 of the prior art).

In order to form a desired image on a sheet by the image forming apparatus, the photosensitive drum 10 is rotated in a predetermined rotating direction (the clockwise direction indicated by the arrow A in FIG. 5) at a predetermined circumferential speed V0 by a rotational force transmitted from a known rotation driving means (not shown) through a rotational center shaft 10*a*. During the rotation of the drum 10, the charger 12 (a charge roller abutted to the photosensitive drum 10 and rotated in the same clockwise direction as the rotating direction of the photosensitive drum 10, in this prior art) charges the outer circumferential surface of the photosensitive drum 10 uniformly with a predetermined voltage. The optical image forming means 14 applies light on the electrically charged outer circumferential surface of the photosensitive drum 10 in accordance with a desired image signal supplied to the optical image forming means 14, thus forming an electrostatic latent image corresponding to the desired image on the outer circumferential surface of the drum 10. The developing means 16 includes a development roller 16*a* abutted to the outer circumferential surface of the photosensitive drum 10. The development roller 16*a* is rotated at a predetermined circumferential speed V1 which is faster than the circumferential speed V0 of the photosensitive drum 10 (in this prior art, V1=2V0) in an opposite direction (counter-clockwise direction in FIG. 5) to the rotating direction of the photosensitive drum 10, and develops the electrostatic latent image on the outer circumferential surface of the photosensitive drum 10, by using toner T in a toner container 16*b*. The toner T has only one component of a non-magnetic material. In FIG. 5, the rotational force is transmitted to the development roller 16*a* by the known rotation driving means (not shown) through a train of gears 16*c* and 16*d*.

A paper sheet P supplied from paper sheet supplying means (not shown) to the image forming apparatus is introduced between the photosensitive drum 10 and the transfer device 18 from the right-hand side thereof in FIG. 5 by conveying means (not shown), and a developed toner image is transferred from the outer circumferential surface of the photosensitive drum 10 to the paper sheet P by the transfer device 18. The sheet P on which the toner image has been transferred is conveyed to a fixation device (not shown), situated on a left side of the image forming apparatus in FIG. 5, by the conveying means, and the transferred toner image is fixed on the paper sheet P by the fixation device.

The cleaner 20 (a doctor blade abutted to the photosensitive drum 10 in this prior art) removes toner RT remaining on the outer circumferential surface of the photosensitive drum 10 after the toner image is transferred, and the removed toner RT is stored in a disuse toner container 22.

In the conventional image forming apparatus of the above-described type, in order to improve a quality of the toner image formed on the paper sheet P in the image forming apparatus, it is important that the photosensitive drum 10 is rotated at a constant circumferential speed.

However, to the photosensitive drum 10 rotated in the conventional image forming apparatus having the above-described structure, not only torque generated by the rotational force transmitted to the photosensitive drum 10 from the known rotation driving means (not shown) but also frictional resistance torque generated by frictional force acting on the photosensitive drum 10 are applied. More specifically, the development roller 16*a* rotated in the direction opposite to the rotating direction of the photosensitive drum 10 in a state in which it is in contact with the outer circumferential surface of the photosensitive drum 10, applies a frictional resistance torque T1 to the photosensitive drum 10 in the same direction as the rotation torque of the photosensitive drum 10. Further, the charge roller of the charger 12 rotated in the same direction as the rotating direction of the photosensitive drum 10 in a state in which it is in contact with the outer circumferential surface of the photosensitive drum 10, the doctor blade of the cleaner 20 fixed to a housing of the image forming apparatus in a state in which it is in contact with the outer circumferential surface of the photosensitive drum 10, and bearings (not shown) for the rotational center shaft 10*a*, apply a frictional resistance torque T2 to the photosensitive drum 10 in a direction opposite the rotation torque direction of the photosensitive drum 10.

Value of the frictional resistance torque T1 can be obtained by multiplying a frictional force F2 applied to the circumferential surface of the drum 10 by the development roller 16*a*, by a radius r of the drum 10 (that is, $T1=F2\times r$), and the frictional force F2 can be obtained by multiplying an abutting pressure F1 by which the development roller 16*a* is abutted on the circumferential surface of the photosensitive drum 10, by a kinetic frictional coefficient $\mu$ acting between the circumferential surface of the photosensitive drum 10 and the development roller 16*a* (that is, $F2=F1\times\mu$; $T1=F1\times\mu\times r$).

The value of the frictional resistance torque T2 applied to the photosensitive drum 10 from rotation resistance members other than the development roller 16*a* is relatively stable, and the rotation resistance members include, for example, the charge roller of the charger 12, the doctor blade of the cleaner 20, the rotational center shaft 10*a* of the photosensitive drum 10, and the bearings (not shown) for the rotational center shaft 10*a* of the drum 10. On the other hand, the value of the frictional resistance torque T1 applied to the photosensitive drum 10 from the development roller 16*a* varies greatly. This is because the circumferential speed V1 of the development roller 16*a* varies greatly due to variation of the amount of the toner T in the toner container 16*b*, variation of the value of the kinetic frictional coefficient $\mu$ acting between the development roller 16*a* and the photosensitive drum 10, the variation of the value of the kinetic frictional coefficient $\mu$ being caused by variation of the amount of the toner T introduced between the development roller 16*a* and the photosensitive drum 10 from the development roller 16*a*, or the like.

If the value of the frictional resistance torque T1 becomes larger than the value of the frictional resistance torque T2 (T1>T2), the variation of the value of the circumferential speed V1 of the development roller 16*a* influences greatly the value of the circumferential speed V0 of the photosensitive drum 10.

In order not to make the variation of the value of the circumferential speed V1 of the development roller 16*a* influence the value of the circumferential speed V0 of the drum 10, in the prior art the abutting pressure F1 of the development roller 16*a* to the circumferential surface of the photosensitive drum 10 is limited to a low level so that the value of the frictional resistance torque T1 becomes smaller than that of another one, namely, the frictional resistance torque T2. However, if the abutting pressure F1 is lowered under a certain level, the amount of the toner T attached to the circumferential surface of the photosensitive drum 10 by the development roller 16*a* is reduced, thus lowering printing quality. Consequently, there is a certain limitation for lowering the value of the abutting pressure F1.

The relationship "T1<T2" can be set up by increasing the abutting pressure of the doctor blade of the cleaner 20 to the circumferential surface of the photosensitive drum 10. However, if the abutting pressure of the doctor blade is increased over a certain level, the circumferential surface of the photosensitive drum 10 will be damaged by the doctor blade, and the variation of the abutting pressure of the doctor blade to the circumferential surface of the photosensitive drum 10 caused by the toner TR remaining on the circumferential surface of the drum 10 will be increased. A large variation of the abutting pressure of the doctor blade causes great variation of the circumferential speed of the rotation of the photosensitive drum 10.

SUMMARY OF THE INVENTION

The present invention is derived from the above-described circumstances, and the object of this invention is to provide an image forming apparatus which can maintain the circumferential speed of the photosensitive drum constant without causing damages to the drum, and improve the quality of a formed image.

In order to achieve the above object, there is provided an image forming apparatus which comprises: a photosensitive drum rotated at a predetermined speed in a predetermined direction, and having an image forming region on an outer circumferential surface thereof; rotation supporting means for rotatably supporting the photosensitive drum; a charger, optical image forming means, development means, transfer means and a cleaner, which are arranged along the outer circumferential surface of the photosensitive drum in a rotational direction of the photosensitive drum; and rotation resistance adjusting means for applying a rotation resistance on a region of the photosensitive drum located outside of the image forming region, and being capable of adjusting a value of the rotation resistance applied on the photosensitive drum. The charger uniformly charges the image forming region of the outer circumferential surface of the photosensitive drum at a predetermined voltage while the drum is rotating; the optical image forming means applies light on the image forming region of the charged outer circumferential surface of the photosensitive drum and forms an electrostatic latent image thereon in accordance with an image forming signal supplied to the optical image forming means; the development means includes a development roller abutted to the image forming region of the circumferential surface of the photosensitive drum and rotated in an opposite direction to the rotating direction of the photosensitive drum, the development roller supplying toner to the image forming region of the circumferential surface of the photosensitive drum so as to develop the electrostatic latent image on the image forming region of the circumferential surface with the toner; the transfer means transfers a developed toner image on the image forming region of the circumferential surface of the photosensitive drum to an image recording medium supplied to the transfer means; and the cleaner removes toner remaining on the image forming region of the circumferential surface of the photosensitive drum after the developed toner image is transferred from the circumferential surface of the photosensitive drum. At least one of the rotation supporting means, the charger, the optical image forming means, the transfer means and the cleaner includes a rotation resistance member for applying a rotation resistance on the photosensitive drum in an opposite direction to a direction of a rotation resistance applied from the development roller to the photosensitive drum. The rotation resistance adjusting means also applies a rotation resistance on the photosensitive drum. And, a value of frictional torque T3 applied from the rotation resistance adjusting means to the photosensitive drum is so set that a relationship "T1<T2+T3" is satisfied, where T1 is a frictional torque applied from the development roller to the photosensitive drum, and T2 is a frictional torque applied from the rotation resistance member to the photosensitive drum.

In the image forming apparatus according to the present invention having the above-described structure, by using the rotation resistance adjusting means which applies a rotation resistance on the region of the photosensitive drum located outside of the image forming region and which is capable of adjusting the value of the rotation resistance applied on the photosensitive drum, the relationship "T1<T2+T3" can be easily satisfied. With this relationship, an influence of the frictional torque T1 applied on the photosensitive drum from the development roller, on the rotation torque of the photosensitive drum can be avoided. Consequently, the circumferential speed of the photosensitive drum can be maintained always constant, thus improving the quality of a formed image. The rotation resistance adjusting means is not brought into contact with the image forming region of the circumferential surface of the photosensitive drum, so that it will not damage the image forming region.

In the image forming apparatus according to the present invention having the above-described structure, it is possible that the rotation resistance adjusting means has an abutment member abutted to the region of the photosensitive drum located outside of the image forming region of the photosensitive drum.

It is preferable that the photosensitive drum includes a rotational center shaft projecting out from at least one of both side surfaces of the photosensitive drum, the abutment member of the rotation resistance adjusting means includes a substantially U-shaped elastic member having a through-hole at its top through which the rotational center shaft of the photosensitive drum is passed and being fixed at both ends, and the abutment member is abutted at its top to at least one of the side surfaces of the photosensitive drum while the rotational center shaft is passed through the through-hole of the top thereof, so theft the abutment member applies a frictional resistance on the photosensitive drum.

The rotation resistance adjusting means being structured as described above is simple in structure, and can be easily manufactured and assembled. Further, the rotation resistance can be easily adjusted by changing a material of the elastic member and sizes thereof.

When the photosensitive drum includes the rotational center shaft projecting out from at least one of both side surfaces of the photosensitive drum, the rotation resistance adjusting means can have a wing member connected to the rotational center shaft of the photosensitive drum and rotated with the rotational center shaft, and a storage container having an internal space for rotatably storing the wing member and a fluid. The fluid may be a viscous fluid.

The rotation resistance adjusting means being structured as described above is simple in structure, and can be easily manufactured and assembled. Further, the rotation resistance can be easily adjusted by changing the shape and sizes of the wing member, and the kind of the fluid.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 3A is an enlarged horizontal cross section of the rotational resistance adjusting means of the embodiment shown in FIG. 1 before a photosensitive drum is set to the adjusting means;

FIG. 3B is an enlarged horizontal cross section of the rotational resistance adjusting means of the embodiment shown in FIG. 1 after the photosensitive drum is set to the adjusting means;

FIG. 4 is an enlarged horizontal cross sectional view of rotation resistance adjusting means and members located around the adjusting means of a main portion of an image forming apparatus according to another embodiment of the present invention; and FIG. 5 is a vertical sectional view showing a main portion of a conventional image forming apparatus.

DETAILED DESCRIPTION OF THE PREFERRED EMBODIMENTS

Various embodiments of the image forming apparatus according to the present invention will now be described in detail with reference to accompanying drawings FIGS. 1 to 4.

[Embodiment]

Figure 1:
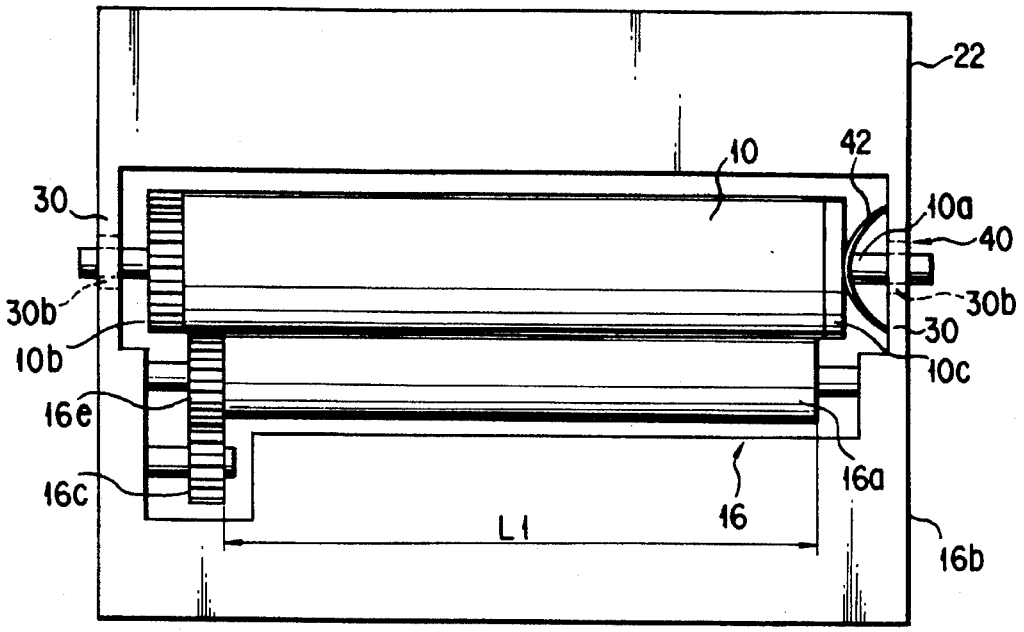
FIG. 1 is a bottom view schematically showing a main portion of an image forming apparatus according to an embodiment the present invention.

FIG. 1 schematically shows a bottom view of a main portion of an image forming apparatus according to an embodiment of the present invention. The basic structure of the main portion of the image forming apparatus according to this embodiment is the same as that of the conventional image forming apparatus described before and shown in FIG. 5. Structural members of this embodiment which are similar to those of the conventional image forming apparatus shown in FIG. 5 will be designated by the same reference numerals used to designate the similar structural members of the conventional one, and detailed descriptions of such members will be omitted.

FIG. 1 shows that both end portions of a rotational center shaft 10*a* projecting from both side surfaces of a photosensitive drum 10 are rotatably supported by a pair of bridge-like portions 30 which connect both side portions of a toner container 16*b* and both side portions of a disused toner container 22 integrally with each other.

FIG. 1 also shows an input gear 10*b* which is provided on one end portion of the photosensitive drum 10 and through which a rotational force from a rotation driving source (not shown) is transmitted to the drum 10, and rotational resistance adjusting means 40 which is particular to the present invention and is provided on the other end of the photosensitive drum 10.

FIG. 1 further shows an input gear 16*e* which is provided on one end portion of the development roller 16*a* located on the same side as one end portion of the photosensitive drum 10 and is engaged with a gear 16*c* located at an exit of a gear train for transmitting a rotational force from a rotation driving source (not shown) to the development roller 16*a*. In FIG. 1, the diameter of the development roller 16*a* looks the same as that of the input gear 16*e*, but the diameter of the input gear 16*e* is smaller than that of the development roller 16*a* in reality, so that the radially outer end of the input gear 16*e* does not disturb a uniform contact of the circumferential surface of the development roller 16*a* with the circumferential surface of the photosensitive drum 10.

As is clear from FIG. 1, the length of the circumferential surface of the photosensitive drum 10 in its longitudinal direction is greater than that of the development roller 16*a* in its longitudinal direction, and the circumferential surface of the development roller 16*a* is brought into contact with only a region L1 interposed between both longitudinal end portions on the circumferential surface of the photosensitive drum 10. Consequently, in the circumferential surface of the photosensitive drum 10, the region L1 is an image forming region.

The rotational center shaft 10*a* of the photosensitive drum 10 is made of, for example, nickel plated steel, in consideration of abrasion resistance, rigidity and fine accuracy in shape and sizes. A disk-shaped friction member 10*c* made of, for example, a polyacetal resin-based material is provided on the outer side surface of the other end portion of the photosensitive drum 10 coaxially and integrally with the photosensitive drum 10 so as to maintain abrasion resistance, rigidity and fine accuracy in shape and sizes of the drum 10.

Figure 2:
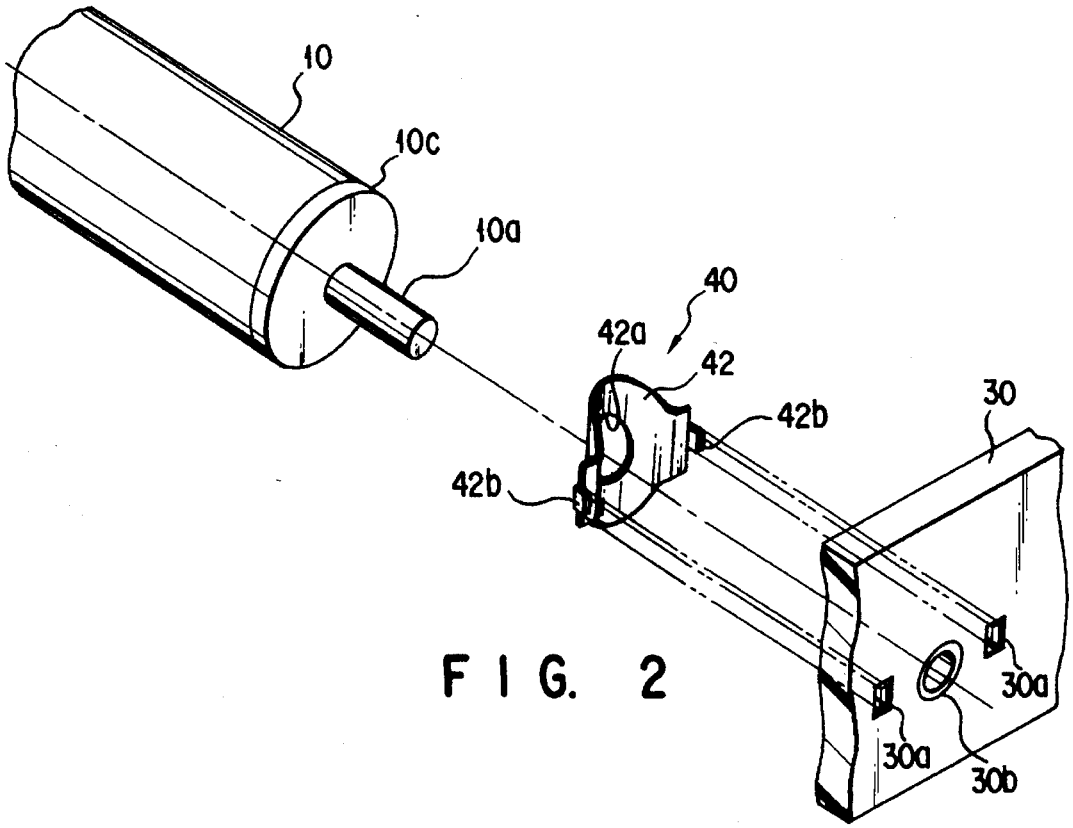
FIG. 2 is an enlarged and disassembled perspective view of rotation resistance adjusting means and members located around the adjusting means in the embodiment shown in FIG. 1.

In this embodiment, the rotation resistance adjusting means 40 includes an abutting member 42 provided on one of the bridge-shaped portions 30 which corresponds to the frictional member 10*c* of the other end portion of the photosensitive drum 10, and the abutting member 42 has a substantially U-shaped horizontal cross-section. The abutting member 42 is made of a relatively rigid material having elastic property (for example, stainless steel). As shown in FIG. 2, a throughhole 42*a* through which the rotational center shaft 10*a* of the photosensitive drum 10 is passed, is formed in a top portion of the abutting member 42, and engaging projections 42*b* are formed at both end portions thereof.

As shown in FIG. 3A, a pair of engaging projections 42*b* provided at both end portions of the abutting member 42 are inserted into a pair of positioning recesses 30*a* formed in one of the bridge-shaped portions 30, and thus the abutting member 42 is positioned on one of the bridge-shaped portions 30, ant the rotation of the abutting member 42 relative to one of the bridge-shaped portions 30 can be prevented.

When both end portions of the rotational center shaft 10*a* of the photosensitive drum 10 are rotatably supported by known rotation supporting means 30*b* such as bearings provided on the pair of bridge-shaped portions 30 as shown in FIG. 1, the abutting member 42 into the throughhole 42*a* of which the corresponding one end portion of the rotational center shaft 10*a* of the photosensitive drum 10 is passed, is pressed at its top portion by the outer side surface of the frictional member 10*c* of the other end portion of the photosensitive drum 10, as shown in FIG. 3B. Consequently, the projecting height from that one of the bridge-shaped portions 30 is decreased by a ,distance d as compared with a free state shown in FIG. 3A.

Accordingly, the abutting member 42 makes the top portion thereof abut against the outer side surface of the frictional member 10*c* of the other end portion of the photosensitive drum 10 with a pressing force corresponding to the distance d. The pressing force can be varied by changing at least one of the thickness, shape and material of the abutting member 42. Therefore, the value of the frictional torque T3 applied on the photosensitive drum 10 by the rotation resistance adjusting means 40 via the abutting member 42 can be arbitrary adjusted.

As in the case of the frictional torque T2 applied on the photosensitive drum 10 by the rotation resistance member such as the charger roller of the charger 12, the optical image forming means 14, the transfer means 18, and the doctor blade of the cleaner 20 shown in FIG. 5, and the rotation supporting means 30*b* shown in FIG. 2, the direction of the frictional torque T3 is opposite to the direction of the frictional torque T1 applied on the photosensitive drum 10 by the development roller 16*a*. The value of the frictional torque T3 is so set that the sum of the frictional torque T3 and the frictional torque T2 is always larger than the value of the frictional torque T1 (i.e. T1<T2+T3).

[Another Embodiment]

FIG. 4 shows an enlarged horizontal cross section of a rotation resistance adjusting means 50 and members located around the adjusting means 50 of a main portion of an image forming apparatus according to another embodiment of the present invention.

This embodiment has basically the same structure as that of the above-described embodiment except that a structure of the rotation resistance adjusting means 50 differs from that of the rotation resistance adjusting means 40 of the above-described embodiment shown in FIGS. 1 to 3B. Therefore, the structure of this embodiment will now be described in detail with regard to the rotation resistance adjusting means 50 with reference to FIG. 4.

The rotation resistance adjusting means 50 of this embodiment includes a plurality; of wing members 50*a* fixed on and radially projecting from the other end portion of the rotational center shaft 10*a* of the photosensitive drum 10 located on the opposite side from the input gear 10*b* (see FIG. 1), and a storage container 50*c* mounted on the other end portion of the rotational center shaft 10*a* and having an internal space which rotatably stores the wing members 50*a* and a viscous fluid 50*b* such as oil in a sealed state. The storage container 50*c* is rotatably supported on the other end portion of the rotational center shaft 10*a* in a sealed state relative to the rotational center shaft 10*a*, and also fixed to the corresponding one of the bridge-shaped portions 30.

In this embodiment, the value of the frictional torque T3 applied on the photosensitive drum 10 by the rotation resistance adjusting means 50 can be adjusted by changing the number, shape or sizes of the wing members 50*a* or the kind of the viscous fluid 50*b*.

As in the case of the frictional torque T2 applied on the photosensitive drum 10 by the rotational resistance member such as the charger roller of the charger 12, the optical image forming means 14, the transfer means 18, and the doctor blade of the cleaner 20 shown in FIG. 5, and the rotation supporting means 30*b* shown in FIG. 2, the direction of the frictional torque T3 is opposite to the direction of the frictional torque T1 applied on the photosensitive drum 10 by the development roller 16*a*. The value of the frictional torque T3 is so set that the sum of the frictional torque T3 and the frictional torque T2 is always larger than the value of the frictional torque T1 (i.e. T1<T2+T3).

Additional advantages and modifications will readily occur to those having ordinary skill in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An image forming apparatus comprising:

a photosensitive drum rotated at a predetermined speed in a predetermined direction, said photosensitive drum having two side surfaces and an image forming region on an outer circumferential surface of said photosensitive drum, and said photosensitive drum including a rotational center shaft projecting out from at least one of both side surfaces of said photosensitive drum;

rotation supporting means for rotatably supporting said photosensitive drum;

a charger, optical image forming means, development means, transfer means and a cleaner, which are arranged along he outer circumferential surface of said photosensitive drum in a rotational direction of said photosensitive drum; and rotation resistance adjusting means for applying a rotation resistance on a region of said photosensitive drum located outside of the image forming region, and for adjusting a value of the rotation resistance applied on said photosensitive drum, said rotation resistance adjusting means having an abutment member abutted to the region of the photosensitive drum located outside of the image forming region of the photosensitive drum, and the abutment member of said rotation resistance adjusting means including a substantially U-shaped elastic member having a throughhole at a top thereof through which the rotational center shaft of said photosensitive drum is passed and being fixed at both ends thereof, and wherein the abutment member is abutted at its top portion to at least one of the side surfaces of said photosensitive drum while the rotational center shaft is passed through the throughhole, so that the abutment member applies a rotational friction resistance on said photosensitive drum;

the charger uniformly charging the image forming region of the outer circumferential surface of said photosensitive drum at a predetermined voltage while said drum is rotating, the optical image forming means applying light on the image forming region of the charged outer circumferential surface of said photosensitive drum and forming an electrostatic latent image thereon in accordance with an image forming signal supplied to the optical image forming means, the development means including a development roller abutted to the image forming region of the circumferential surface of the photosensitive drum and rotated in an opposite direction to the rotating direction of said photosensitive drum, the development roller supplying toner to the image forming region of the circumferential surface of said photosensitive drum so as to develop the electrostatic latent image on the image forming region of the circumferential surface with the toner, the transfer means transferring a developed toner image on the image forming region of the circumferential surface of said photosensitive drum to an image recording medium supplied to the transfer means, and the cleaner removing toner remaining on the image forming region of the circumferential surface of said photosensitive drum after the developed toner image is transferred, from the circumferential surface of said photosensitive drum;

at least one of the rotation supporting means, the charger, the optical image forming means, the transfer means and the cleaner including rotation resistance member for applying a rotation resistance on said photosensitive drum in an opposite direction to a direction of a rotation resistance applied form the development roller to the photosensitive drum; and a value of frictional torque T3 applied from the rotation resistance adjusting means to said photosensitive drum being so set that a relationship "T1<T2+T3" is satisfied, where T1 is a frictional torque applied form the development roller to said photosensitive drum, and T2 is a frictional torque applied from the rotation resistance member to said photosensitive drum.

2. An image forming apparatus comprising:

a photosensitive drum rotated at a predetermined speed in a predetermined direction, said photosensitive drum having two side surfaces and an image forming region on an outer circumferential surface of said photosensitive drum, and said photosensitive drum including a rotational center shaft projecting out from at least one of both side surfaces of said photosensitive drum;

rotation supporting means for rotatably supporting said photosensitive drum;

a charger, optical image forming means, development means, transfer means and a cleaner, which are arranged along the outer circumferential surface of said photosensitive drum in a rotational direction of said photosensitive drum; and rotation resistance adjusting means for applying a rotation resistance on a region of said photosensitive drum located outside of the image forming region, and for adjusting a value of the rotation resistance applied on said photosensitive drum, said rotation resistance adjusting means including a wing member connected to the rotational center shaft of said photosensitive drum and rotated with the rotational center shaft, and a storage container having an internal space for rotatably storing the wing member and containing a fluid;

the charger uniformly changing the image forming region of the outer circumferential surface of said photosensitive drum at a predetermined voltage while said drum is rotating, the optical image forming means applying light on the image forming region of the charged outer circumferential surface of said photosensitive drum and forming an electrostatic latent image thereon in accordance with an image forming signal supplied to the optical image forming means, the development means including a development roller abutted to the image forming region of the circumferential surface of the photosensitive drum and rotated in an opposite direction to the rotating direction of said photosensitive drum, the development roller supplying toner to the image forming region of the circumferential surface of said photosensitive drum so as to develop the electrostatic latent image on the image forming region of the circumferential surface with the toner, the transfer means transferring a developed toner image on the image forming region of the circumferential surface of said photosensitive drum to an image recording medium supplied to the transfer means, and the cleaner removing toner remaining on the image forming region of the circumferential surface of said photosensitive drum after the developed toner image is transferred, from the circumferential surface of said photosensitive drum;

at least one of the rotation supporting means, the charger, the optical image forming means, the transfer means and the cleaner including a rotational resistance member for applying a rotation resistance on said photosensitive drum in an opposite direction to a direction of a rotation resistance applied from the development roller to the photosensitive drum;

said rotation resistance adjusting means also applying a rotation resistance on said photosensitive drum; and a value of frictional torque T3 applied from the rotation resistance adjusting means to said photosensitive drum being so set that a relationship "T1<T2+T3" is satisfied, where T1 is a frictional torque applied from the development roller to said photosensitive drum, and T2 is a frictional torque applied from the rotational resistance member to said photosensitive drum.

* * * * *